US012540523B2

(12) United States Patent
Lopes De Oliveira et al.

(10) Patent No.: US 12,540,523 B2
(45) Date of Patent: Feb. 3, 2026

(54) SUBSEA CONNECTOR

(71) Applicant: AKER SOLUTIONS DO BRASIL LTDA, Sao Jose Dos Pinhais Parana (BR)

(72) Inventors: Paulo Roberto Lopes De Oliveira, Curitiba Parana (BR); Alan Kessler, Curitiba Parana (BR); Hugo Novakoski, Mobile, AL (US); Marcelo Maldaner, Curitiba Parana (BR); Eduardo Dering, Curitiba Parana (BR); Yukyhiro Oikava, Curitiba Parana (BR); Rodrigo Dias, Curitiba Parana (BR); Willian Segala, Curitiba Parana (BR)

(73) Assignee: AKER SOLUTIONS DO BRASIL LTDA, Sao Jose Dos Pinhais Parana (BR)

( * ) Notice: Subject to any disclaimer, the term of this patent is extended or adjusted under 35 U.S.C. 154(b) by 0 days.

(21) Appl. No.: 18/748,140

(22) Filed: Jun. 20, 2024

(65) Prior Publication Data

US 2024/0426184 A1 Dec. 26, 2024

(30) Foreign Application Priority Data

Jun. 23, 2023 (BR) ..... 102023012760-6

(51) Int. Cl.
*E21B 33/038* (2006.01)

(52) U.S. Cl.
CPC ..... *E21B 33/038* (2013.01)

(58) Field of Classification Search
CPC ..... E21B 33/08
See application file for complete search history.

(56) References Cited

U.S. PATENT DOCUMENTS 3,321,217 A * 5/1967 Ahlstone ..... E21B 33/038 285/379
4,453,745 A 6/1984 Nelson
(Continued)

FOREIGN PATENT DOCUMENTS

WO WO 03/002845 A1 1/2003
WO WO 2010/069863 A1 6/2010
(Continued)

*Primary Examiner* — James G Sayre
(74) *Attorney, Agent, or Firm* — Jeffrey D. Frantz

(57) ABSTRACT

A connector for securing to an end of an elongate element includes a connector body, a locking dog, a locking part, and a floating piston. The connector body has window(s) and encloses a main passage. The locking dog extends through the window(s), is movable between an operative position where the locking dog extends into the main passage, and an inoperative position where the locking dog is retracted. The locking part moves via a locking actuator to move the locking dog between the operative and inoperative positions. An actuator sleeve of the locking actuator encloses a first and a second volume around the connector body. The actuator sleeve moves to decrease the first volume/increase the second volume, and to increase the first volume/decrease the second volume. The floating piston divides the second volume into and lower portions. The floating piston moves to vary a size of the upper and lower portions.

8 Claims, 13 Drawing Sheets

(56) References Cited

U.S. PATENT DOCUMENTS

| | | | | |
|---|---|---|---|---|
| 4,699,215 | A | 10/1987 | Cuiper | |
| 4,708,376 | A | 11/1987 | Jennings et al. | |
| 5,607,019 | A | 3/1997 | Kent | |
| 6,129,149 | A | 10/2000 | Beall | |
| 2004/0168810 | A1 | 9/2004 | Emmerson | |
| 2005/0001427 | A1 | 1/2005 | Liew | |
| 2005/0146137 | A1 | 7/2005 | Davidson et al. | |
| 2009/0014184 | A1* | 1/2009 | Voss ..... | F16L 37/62 166/345 |
| 2010/0288503 | A1 | 11/2010 | Cuiper et al. | |
| 2011/0227336 | A1 | 9/2011 | Mogedal et al. | |
| 2011/0241335 | A1 | 10/2011 | Smith | |
| 2019/0085650 | A1 | 3/2019 | Andueza | |
| 2020/0056439 | A1 | 2/2020 | Andueza et al. | |

FOREIGN PATENT DOCUMENTS

| | | | |
|---|---|---|---|
| WO | WO 2010/081621 | A2 | 7/2010 |
| WO | WO 2017/147667 | A1 | 9/2017 |
| WO | WO 2018/191803 | A1 | 10/2018 |

* cited by examiner (a)

(b)

(c)

(a)

(b)

(c)

(a)

(b)

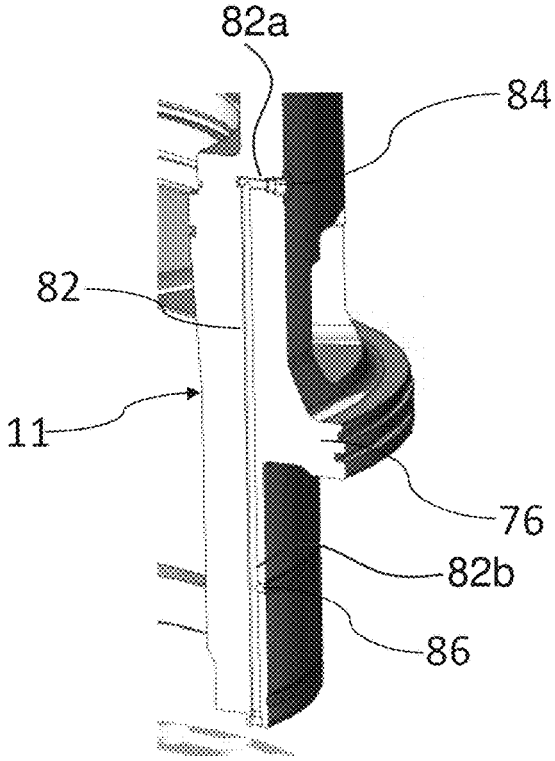
(a)
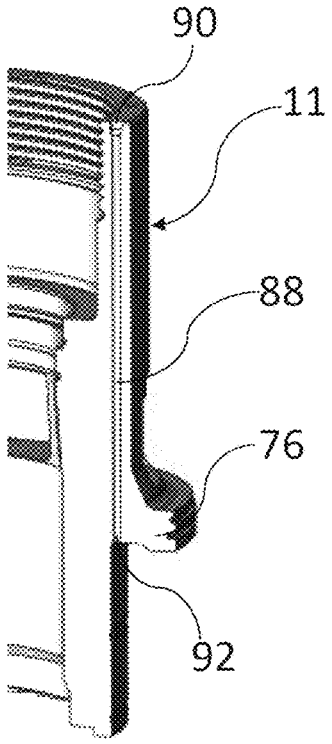
(b)
Fig. 14
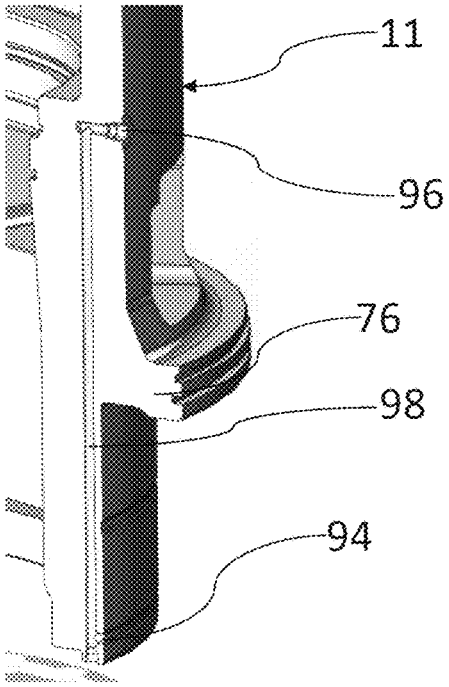
(c)

SUBSEA CONNECTOR

CROSS REFERENCE TO PRIOR APPLICATIONS

Priority is claimed to Brazilian Patent Application No. BR 102023012760-6, filed Jun. 23, 2023.

FIELD

The present disclosure relates to a subsea connector, including but not limited to such connectors associated with wellheads and wellhead equipment.

BACKGROUND

Wellheads and associated components, such as valve tree assemblies, require secure, leak proof connections. These connections are safety-critical, and reliability and integrity are of critical importance. Connectors for this purpose will also usually require functionality for remotely operated, subsea connect/disconnect sequences, for example, to allow for a quick installation of a valve tree or for its quick and easy removal. Long-term operational reliability of the connector system is for this purpose also important, for example, in view of the fact that the connector may remain in the installed position for long periods of time (in some cases, for years). Conventional wellhead connectors typically include a locking mechanism, an actuator for the locking mechanism, and means for maintaining the connector in the locked condition once the actuating force is removed in order to preclude well operations from loosening or retracting the connector's locking mechanism.

Publications which may be useful to understand the background of the present invention include: U.S. Pat. Nos. 4,453,745; 4,699,215; 5,607,019; 6,129,149; US 2010/288503 A1; WO 17/147667 A1; WO 10/069863 A1; WO 03/002845 A1; WO 10/081621 A1; US 2005/0146137 A1; US 200/5001427 A1; U.S. Pat. No. 4,708,376; and WO 18/191803 A1.

SUMMARY

An aspect of the present invention is to further improve technology relating to such subsea connectors or at least to provide alternatives to known solutions and techniques.

In an embodiment, the present invention provides a connector for securing to an end of an elongate element. The connector includes a connector body, a locking dog, a locking part, and a floating piston. The connector body is tubular. The connector body comprise a first end, a second end, and at least one window. The connector body encloses a main passage having a longitudinal axis. The main passage extends from the first end to the second end of the connector body. The locking dog comprises a front end. The locking dog is configured to extend through the at least one window and to be movable between an operative position in which the front end of the locking dog extends into the main passage, and an inoperative position in which the locking dog is retracted radially outwardly relative to the operative position. The locking part engages with the locking dog and is movable via a locking actuator which is operated via a fluid pressure so as to move the locking dog between the operative position and the inoperative position. The locking actuator comprises an actuator sleeve which is mounted around the connector body to enclose a first volume which is substantially fluid tight around the connector body and a second volume which is substantially fluid tight around the connector body. The actuator sleeve is movable in a first direction along the connector body to decrease the first volume and to increase the second volume, and in a second direction to increase the first volume and to decrease the second volume. The floating piston is arranged in the second volume to divide the second volume into an upper portion and a lower portion. The floating piston engages with the connector body and the actuator sleeve to provide a substantially fluid tight seal between the upper portion and the lower portion of the second volume while being moveable relative to the connector body and the actuator sleeve so as to vary a size of the upper portion relative to a size of the lower portion.

BRIEF DESCRIPTION OF THE DRAWINGS

The present invention is described in greater detail below on the basis of embodiments and of the drawings in which:

FIG. 14 shows a cut-away perspective view of the body of a connector according to the present invention to show (a) the primary unlock inlet port, outlet port and conduit, (b) the lock inlet port, outlet port and conduit, and (c) the secondary unlock inlet port, outlet port and conduit.

DETAILED DESCRIPTION

Figure 1:
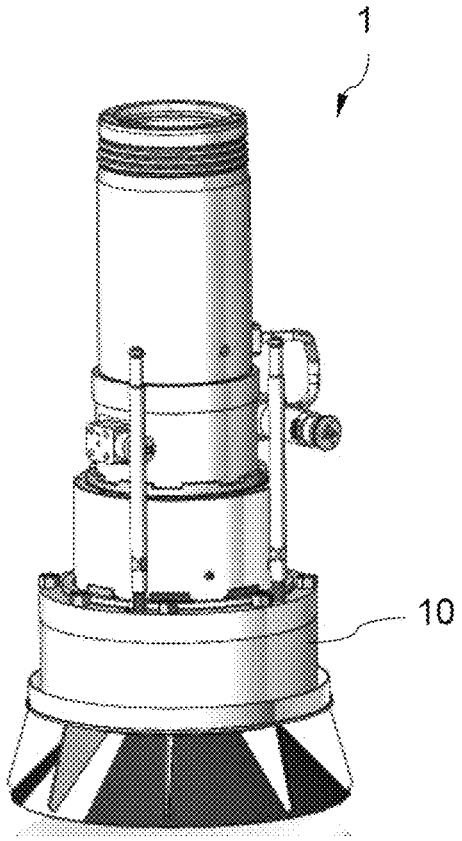
FIG. 1 is a perspective view of a connector according to the present invention arranged in a tubing head spool stack.

A first aspect of the present invention provides a connector for securing to an end of an elongate element, the connector having a connector body with a first end and a second end, the connector body enclosing a main passage which extends from the first end to the second end of the body and having a longitudinal axis, the connector body having at least one window through which a locking dog extends, the locking dog being movable between an operative position in which a front end of the locking dog extends into the main passage, and an inoperative position in which the locking dog is retracted radially outwardly relative to the operative position, the connector being further provided with a locking part which engages with the locking dog and which is movable via a fluid pressure operated locking actuator to move the locking dog between its operative and inoperative position, the locking actuator comprising an actuator sleeve which is mounted around the connector body to enclose a first substantially fluid tight volume around the connector body and a second substantially fluid tight volume around the connector body, and which is movable in a first direction along the connector body to decrease the first volume and increase the second volume, and in a second direction to increase the first volume and decrease the second volume, wherein the connector is further provided with a floating piston which is located in the second volume and divides the second volume into an upper portion and a lower portion, the floating piston engaging with the connector body and the actuator sleeve to provide a substantially fluid tight seal between the upper and lower portion of the second volume while being moveable relative to the connector body and actuator sleeve to vary the size of the upper portion relative to the size of the lower portion.

The connector may further be provided with a first inlet port which is fluidly connected to the upper portion of the second volume, and a second inlet port which is fluidly connected to the lower portion of the second volume. As such, pressurized fluid can be supplied to the second volume in order to move the locking actuator in the first direction, either via the first inlet port or the second inlet port.

The connector may be provided with a third inlet port which is fluidly connected to the first volume, via which pressurized fluid may be supplied to the first volume in order to move the locking actuator in the second direction.

The connector may be configured so that movement of the actuator sleeve in the first direction moves the locking part so that the locking part moves the locking dog to its inoperative position, and movement of the actuator sleeve in the second direction moves the locking part so that the locking part moves the locking dog to its operative position.

The connector may be configured so that movement of the locking dog between its operative and inoperative position is translational movement along an axis of locking dog movement. The axis of locking dog movement can, for example, be generally perpendicular to the longitudinal axis of the main passage.

The locking part may comprise a locking ring which is mounted around the connector body to engage with a rear end of the locking dog, the rear end of the locking dog being at the opposite end of the locking dog to the front end, and which is movable relative to the connector body generally perpendicular to the axis of locking dog movement between a lock position in which it pushes the locking dog to its operative position, and an unlock position to move the locking dog to its inoperative position.

The connector may comprise a spring element which urges the locking dog from its operative position to its inoperative position.

The rear end of the locking dog may have an inclined face which is inclined at an angle of between 10° and 80° to the axis of locking dog movement, and an end face which lies generally perpendicular to the axis of locking dog movement. In this case, the locking ring have a radially inwardly facing surface which is provided with an inclined portion which is arranged so that, when the lock ring is in its unlock position, the inclined portion of the locking ring bears on the inclined face of the rear end of the locking dog, and an end portion which lies generally perpendicular to the axis of locking dog movement and which is arranged so that it bears on the end face of the locking dog when the locking ring is in its lock position.

The rear end of the locking dog may also have a second inclined face which is inclined at an angle of between 10° and 80° to the axis of locking dog movement, and a second end face which lies generally perpendicular to the axis of locking dog movement, the second end face lying between the two inclined faces. In this case, the radially inwardly facing surface of the locking ring can, for example, be further provided with a second inclined portion which is arranged so that when the lock ring is in its unlock position, the second inclined portion of the locking ring bears on the second inclined face of the rear end of the locking dog, and a second end portion which lies generally perpendicular to the axis of locking dog movement and which is arranged so that it bears on the second end face of the locking dog when the locking ring is in its lock position.

The connector body may have a radially inward facing surface which surrounds the main passage, the radially inward facing surface at the first end of the connector body being provided with a threaded portion which carries a screw thread.

The locking dog receiving window may in this case be located between the threaded portion and the second end of the connector body.

The connector may further be provided with a threaded ring having a radially outwardly facing surface which carries a thread which can be screwed into the threaded portion of the first end of the connector body.

The threaded ring may have a radially inward facing surface which carries a screw thread which is oppositely directed to the screw thread on the radially outwardly facing surface. The connector may alternatively further be provided with second threaded ring having a radially inward facing surface which carries a screw thread which is oppositely directed to the screw thread on the radially outwardly facing surface of the threaded ring.

The connector body may be configured so that the main passage has a larger diameter portion at the first end of the connector body, a smaller diameter portion adjacent the larger diameter portion, and a shoulder between the larger diameter portion and the smaller diameter portion.

A second aspect of the present invention provides a connector for securing to an end of an elongate element, the connector having a tubular connector body with a first end and a second end, the connector body enclosing a main passage which extends from the first end to the second end of the body and having a longitudinal axis, the connector body having at least one window through which a locking dog extends, the locking dog being movable along a locking dog axis of movement between an operative position in which a front end of the locking dog extends into the main passage, and an inoperative position in which the locking dog is retracted radially outwardly relative to the operative position, the connector being further provided with a locking part which engages with the locking dog and which is movable via a fluid pressure operated locking actuator to move the locking dog between its operative and inoperative position, the locking part comprising a locking ring which is mounted around the connector body to engage with a rear end of the locking dog, the rear end of the locking dog being at the opposite end of the locking dog to the front end, and which is movable relative to the connector body generally perpendicular to the axis of locking dog movement between a lock position in which it pushes the locking dog to its operative position, and an unlock position to move the locking dog to its inoperative position, wherein the rear end of the locking dog has an inclined face which is inclined at an angle of between 10° and 80° to the axis of locking dog movement, and an end face which lies generally perpendicular to the axis of locking dog movement, and the locking ring has a radially inwardly facing surface which is provided with an inclined portion which is arranged so that when the lock ring is in its unlock position, the inclined portion of the locking ring bears on the inclined face of the rear end of the locking dog, and an end portion which lies generally perpendicular to the axis of locking dog movement and which is arranged so that it bears on the end face of the locking dog when the locking ring is in its lock position.

The rear end of the locking dog may also have a second inclined face which is inclined at an angle of between 10° and 80° to the axis of locking dog movement, and a second end face which lies generally perpendicular to the axis of locking dog movement, the second end face lying between the two inclined faces. In this case, the radially inwardly facing surface of the locking ring can, for example, be further provided with a second inclined portion which is arranged so that when the lock ring is in its unlock position, the second inclined portion of the locking ring bears on the second inclined face of the rear end of the locking dog, and a second end portion which lies generally perpendicular to the axis of locking dog movement and which is arranged so that it bears on the second end face of the locking dog when the locking ring is in its lock position.

The axis of locking dog movement can, for example, be generally perpendicular to the longitudinal axis of the main passage.

The connector may comprise a spring element which urges the locking dog from its operative position to its inoperative position.

The locking actuator may comprise an actuator sleeve which is mounted around the connector body to enclose a first substantially fluid tight volume around the connector body and a second substantially fluid tight volume around the connector body, and which is movable in a first direction along the connector body to decrease the first volume and increase the second volume, and in a second direction to increase the first volume and decrease the second volume. The connector may in this case be further provided with a floating piston which is located in the second volume and which divides the second volume into an upper portion and a lower portion, the floating piston engaging with the connector body and the actuator sleeve to provide a substantially fluid tight seal between the upper and lower portion of the second volume while being moveable relative to the connector body and actuator sleeve to vary the size of the upper portion relative to the size of the lower portion.

The connector may further be provided with a first inlet port which is fluidly connected to the upper portion of the second volume, and a second inlet port which is fluidly connected to the lower portion of the second volume. Pressurized fluid can as such be supplied to the second volume in order to move the locking actuator in the first direction, via either the first inlet port or the second inlet port.

The connector may be provided with a third inlet port which is fluidly connected to the first volume, via which pressurized fluid may be supplied to the first volume in order to move the locking actuator in the second direction.

The connector may be configured so that movement of the actuator sleeve in the first direction moves the locking part so that the locking part moves the locking dog to its inoperative position, and movement of the actuator sleeve in the second direction moves the locking part so that the locking part moves the locking dog to its operative position.

The connector body may have a radially inward facing surface which surrounds the main passage, the radially inward facing surface at the first end of the connector body being provided with a threaded portion which carries a screw thread.

The locking dog receiving window may in this case be located between the threaded portion and the second end of the connector body.

The connector may further be provided with a threaded ring having a radially outwardly facing surface which carries a thread which can be screwed into the threaded portion of the first end of the connector body.

The threaded ring may have a radially inward facing surface which carries a screw thread which is oppositely directed to the screw thread on the radially outwardly facing surface. The connector may alternatively further be provided with second threaded ring having a radially inward facing surface which carries a screw thread which is oppositely directed to the screw thread on the radially outwardly facing surface of the threaded ring.

The connector body may be configured so that the main passage has a larger diameter portion at the first end of the connector body, a smaller diameter portion adjacent the larger diameter portion, and a shoulder between the larger diameter portion and the smaller A third aspect of the present invention provides a connector for securing to an end of an elongate element, the connector having a tubular connector body with a first end and a second end, the connector body enclosing a main passage which extends from the first end to the second end of the body and having a longitudinal axis, the connector body having at least one window through which a locking dog extends, the locking dog being movable between an operative position in which a front end of the locking dog extends into the main passage, and an inoperative position in which the locking dog is retracted radially outwardly relative to the operative position, the connector being further provided with a locking part which engages with the locking dog and which is movable via a fluid pressure operated locking actuator to move the locking dog between its operative and inoperative position, wherein the connector body has a radially inward facing surface which surrounds the main passage, the radially inward facing surface at the first end of the connector body being provided with a threaded portion which carries a screw thread.

The locking dog receiving window may in this case be located between the threaded portion and the second end of the connector body.

The connector may further be provided with a threaded ring having a radially outwardly facing surface which carries a thread which can be screwed into the threaded portion of the first end of the connector body.

The threaded ring may have a radially inward facing surface which carries a screw thread which is oppositely directed to the screw thread on the radially outwardly facing surface. The connector may alternatively further be provided with second threaded ring having a radially inward facing surface which carries a screw thread which is oppositely directed to the screw thread on the radially outwardly facing surface of the threaded ring.

The locking actuator may comprise an actuator sleeve which is mounted around the connector body to enclose a first substantially fluid tight volume around the connector body and a second substantially fluid tight volume around the connector body, and which is movable in a first direction along the connector body to decrease the first volume and increase the second volume, and in a second direction to increase the first volume and decrease the second volume, wherein the connector is further provided with a floating piston which is located in the second volume and divides the second volume into an upper portion and a lower portion, the floating piston engaging with the connector body and the actuator sleeve to provide a substantially fluid tight seal between the upper and lower portion of the second volume while being moveable relative to the connector body and actuator sleeve to vary the size of the upper portion relative to the size of the lower portion.

The connector may further be provided with a first inlet port which is fluidly connected to the upper portion of the second volume, and a second inlet port which is fluidly connected to the lower portion of the second volume. Pressurized fluid can as such be supplied to the second volume in order to move the locking actuator in the first direction, via either the first inlet port or the second inlet port.

The connector may be provided with a third inlet port which is fluidly connected to the first volume, via which pressurized fluid may be supplied to the first volume in order to move the locking actuator in the second direction.

The connector may be configured such that movement of the actuator sleeve in the first direction moves the locking part so that the locking part moves the locking dog to its inoperative position, and movement of the actuator sleeve in the second direction moves the locking part so that the locking part moves the locking dog to its operative position.

The connector may be configured so that movement of the locking dog between its operative and inoperative position is a translational movement along an axis of locking dog movement. The axis of locking dog movement can, for example, be generally perpendicular to the longitudinal axis of the main passage.

The locking part may comprise a locking ring which is mounted around the connector body to engage with a rear end of the locking dog, the rear end of the locking dog being at the opposite end of the locking dog to the front end, and which is movable relative to the connector body generally perpendicular to the axis of locking dog movement between a lock position in which it pushes the locking dog to its operative position, and an unlock position to move the locking dog to its inoperative position.

The connector may comprise a spring element which urges the locking dog from its operative position to its inoperative position.

The rear end of the locking dog may have an inclined face which is inclined at an angle of between 10° and 80° to the axis of locking dog movement, and an end face which lies generally perpendicular to the axis of locking dog movement. In this case, the locking ring can, for example, have a radially inwardly facing surface which is provided with an inclined portion which is arranged so that when the lock ring is in its unlock position, the inclined portion of the locking ring bears on the inclined face of the rear end of the locking dog, and an end portion which lies generally perpendicular to the axis of locking dog movement and which is arranged so that it bears on the end face of the locking dog when the locking ring is in its lock position.

The rear end of the locking dog may also have a second inclined face which is inclined at an angle of between 10° and 80° to the axis of locking dog movement, and a second end face which lies generally perpendicular to the axis of locking dog movement, the second end face lying between the two inclined faces. In this case, the radially inwardly facing surface of the locking ring can, for example, be further provided with a second inclined portion which is arranged so that when the lock ring is in its unlock position, the second inclined portion of the locking ring bears on the second inclined face of the rear end of the locking dog, and a second end portion which lies generally perpendicular to the axis of locking dog movement and which is arranged so that it bears on the second end face of the locking dog when the locking ring is in its lock position.

The connector body may be configured so that the main passage has a larger diameter portion at the first end of the connector body, a smaller diameter portion adjacent the larger diameter portion, and a shoulder between the larger diameter portion and the smaller A fourth aspect of the present invention provides a method of securing a cylindrical element to a connector according to the third aspect of the present invention, the cylindrical element having at one end a screw thread on a radially outwardly facing surface thereof, the method comprising mounting a first threaded ring having a radially outwardly facing surface which carries a thread onto the end of the elongate element, screwing a second threaded ring with a radially inward facing surface which carries a screw thread which is oppositely directed to the screw thread on the radially outwardly facing surface of the first threaded ring onto the screw thread on the end of the cylindrical element, inserting the end of the cylindrical element into the main passage of the connector body at the first end thereof, and screwing the first threaded ring into the threaded portion of the first end of the connector body.

The method may further comprise inserting a second elongate element into the main passage of the connector body at the second end thereof and operating the locking actuator to move the locking dog to its operative position so that it engages with the second elongate element and locks the second elongate element in the connector body.

A fifth aspect of the present invention provides a method of securing a cylindrical element to a connector according to the third aspect of the present invention, the cylindrical element having at one end a screw thread on a radially outwardly facing surface thereof, the method comprising taking a threaded ring having a radially outwardly facing surface which carries an outer screw thread and a radially inward facing surface which carries an inner screw thread which is oppositely directed to the screw thread on the radially outwardly facing surface, screwing the threaded ring onto the screw thread at the end of the elongate element, inserting the end of the cylindrical element into the main passage of the connector body at the first end thereof, and screwing the outer screw thread of the threaded ring into the threaded portion of the first end of the connector body.

The method may further comprise inserting a second elongate element into the main passage of the connector body at the second end thereof and operating the locking actuator to move the locking dog to its operative position so that it engages with the second elongate element and locks the second elongate element in the connector body.

These and other characteristics will become clear from the following description of illustrative embodiments, given as non-restrictive examples, with reference to the attached drawings.

Figure 2:
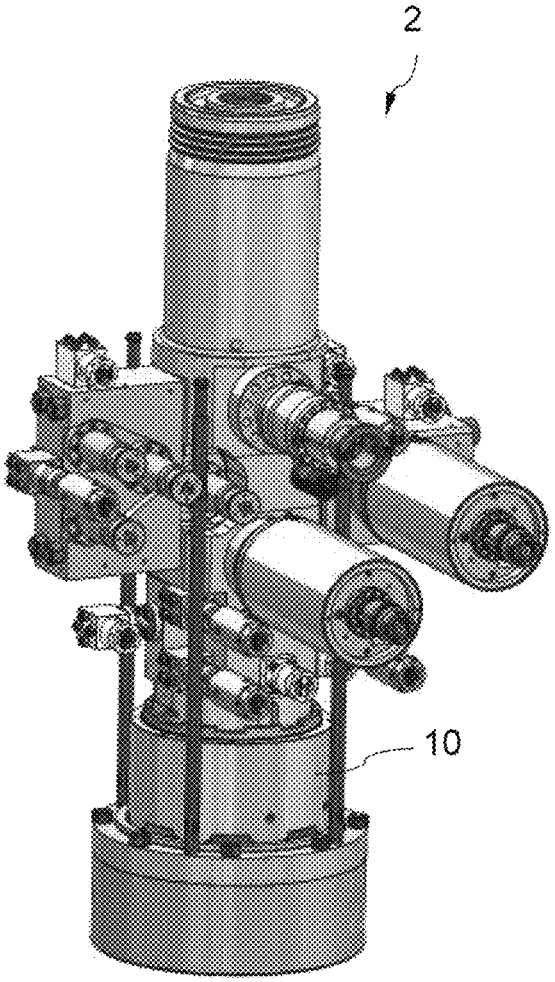
FIG. 2 is a perspective view of a connector according to the present invention arranged in a valve tree stack.

Embodiments of the present disclosure relate to a connector and a connection assembly adapted for connection of two elongate elements, which in these embodiments are circular or pipe-shaped subsea elements, such as two components of a wellhead assembly. FIGS. 1 and 2 illustrate two embodiments of a connector 10 arranged in a tubing head spool stack 1 (FIG. 1) and in a valve tree ("Xmas tree") stack 2 (FIG. 2). The connector 10 provides a connection for equipment in the wellhead assembly, such as a connection of the Xmas tree to a wellhead or connection of a riser assembly to the Xmas tree. The connector 10 may, for example, be based on an 18¾" H-4 connector interface. The connector 10 may be used, for example, in vertical Xmas tree systems, horizontal Xmas tree systems, or with tubing head spools.

Figure 3:
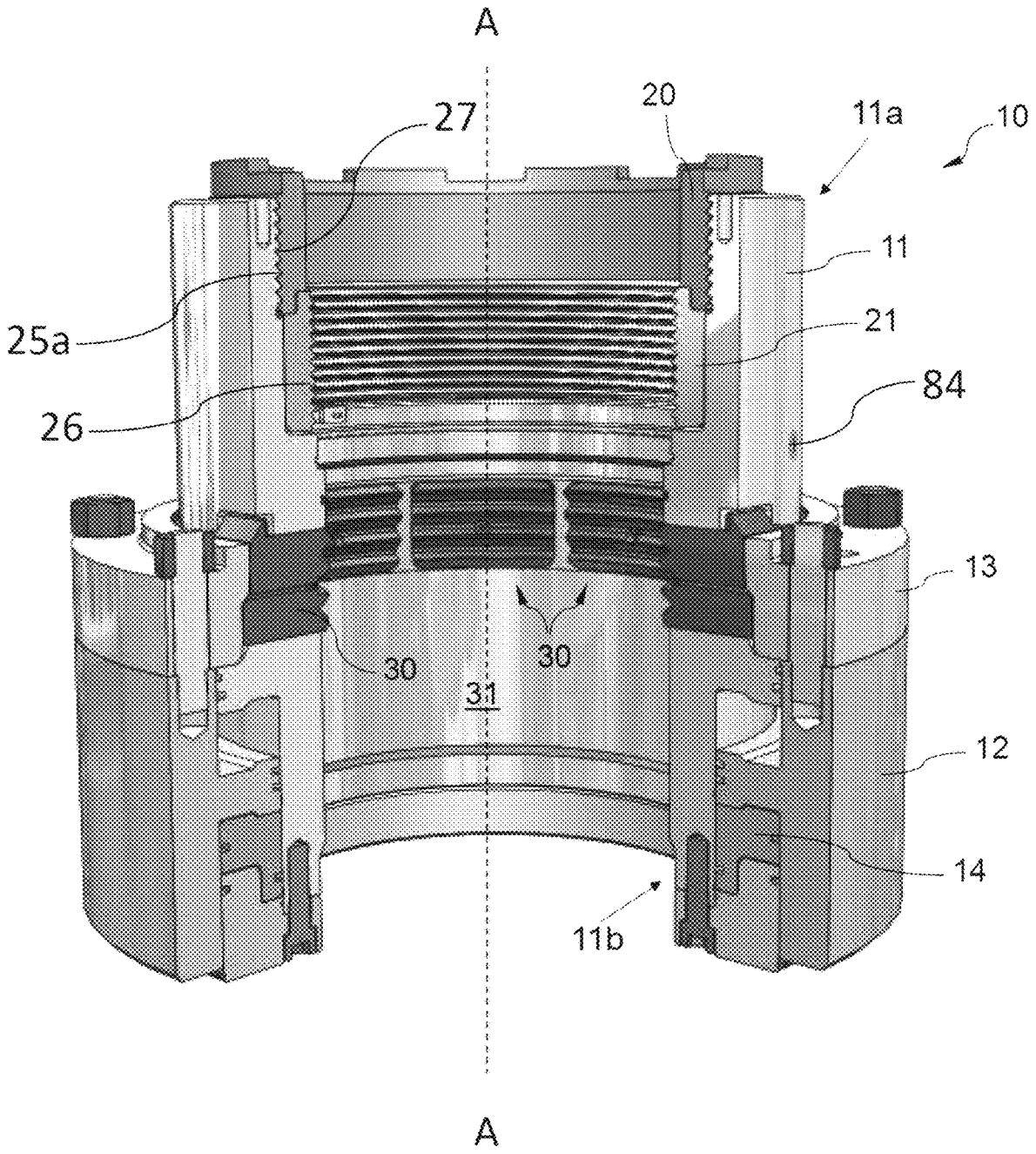
FIG. 3 is a perspective, cut-away view of a connector according to the present invention.
Figure 4:
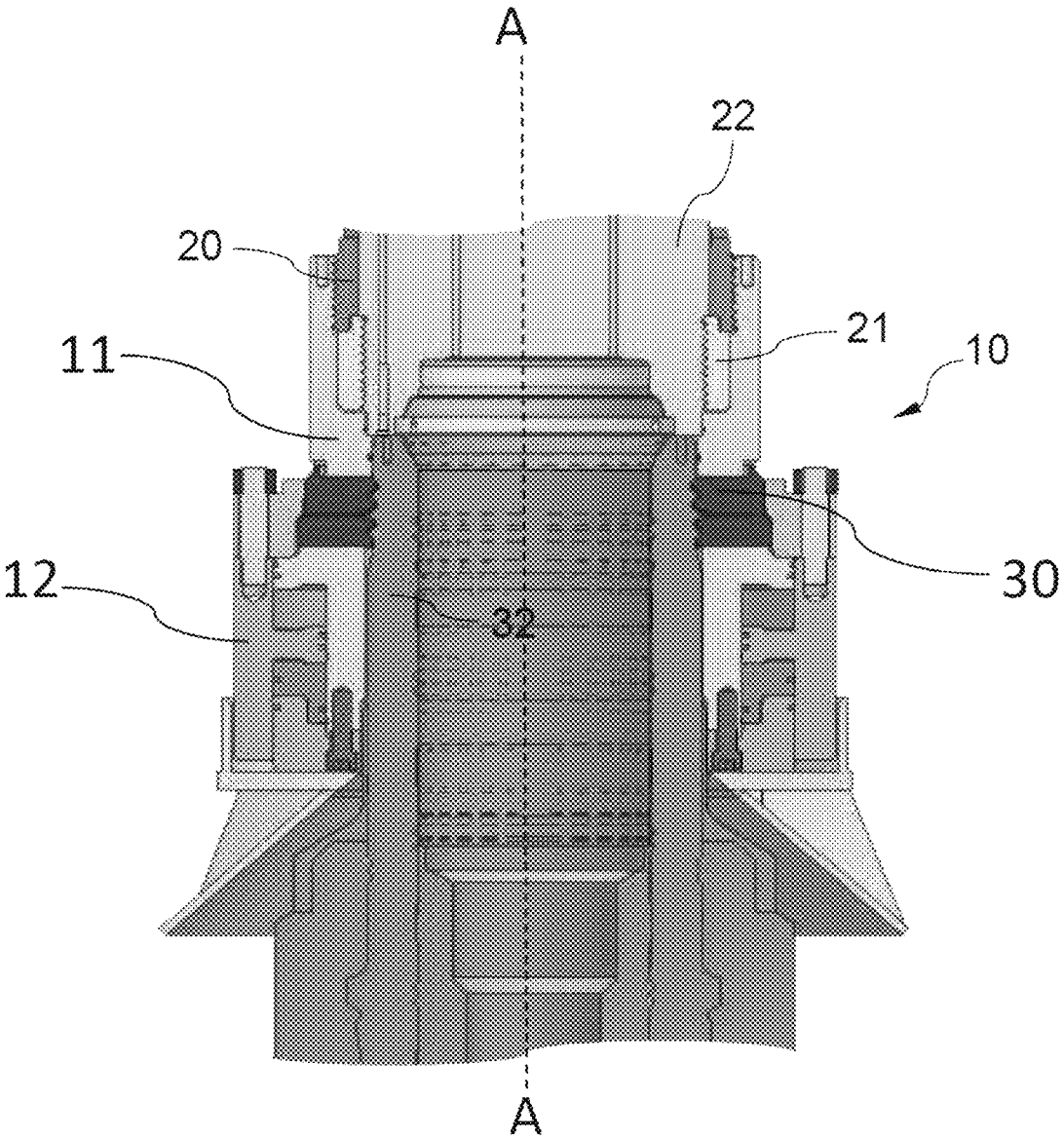
FIG. 4 is an illustration of a longitudinal cross-section through the connector illustrated in FIG. 3 secured to the top of a member such as a wellhead.

FIGS. 3 and 4 illustrate the connector 10 in further detail. The connector 10 comprises a tubular connector body 11 arranged for connection between a body 22 (not shown in FIG. 3) which body 22 can, for example, have an elongate or a cylindrical shape and be part of a tubing head spool stack, or Christmas tree as discussed above, or a lower end of a valve tree, a blowout preventer assembly, or a marine riser, and a member 32 (not shown in FIG. 3) such as a wellhead. Member 32 can, for example, have a cylindrical shape. In this example, as the connector 10 is adapted to connect two cylindrical elements, the connector body 11 has a generally circular transverse cross-section.

The connector body 11 has a first end 11*a* and a second end 11*b*, and encloses a passage 31 which can, for example, be cylindrical, the passage 31 extending from the first end 11*a* to the second end 11*b* of the connector body 11 and has a longitudinal axis A. The connector body 11 has a longitudinal axis which extends from the first end 11*a* to the second end 11*b* which may be parallel to (but in this embodiment is coaxial with) the longitudinal axis A of the passage 31. The connector body 11 has a radially inwardly facing surface 25 which, at the first end 11*a* of the connector body 11, is provided a thread 25*a*.

The connector 10 further comprises an upper threaded ring 20 and a lower threaded ring 21 for securing the body 22 in the connector body 11, described in further detail below. A plurality of locking dogs 30 are disposed circumferentially about the passage 31 of the connector body 11, and are configured to engage with a member 32 (not shown in FIG. 3) inserted into the passage 31 at the second end 11*b* in order to releasably lock the body 22 to the member 32 via the connector 10, as illustrated in FIG. 4. The member 32 could be part of a wellhead or a Christmas tree as described above. The locking dogs 30 are arranged in radially arranged openings (or "windows") in the connector body 11 and have a toothed or serrated front face 30*a*, which is arranged radially inwardly, facing the passage 31 of the connector body 11, for engaging with a correspondingly serrated portion of the member 32, as shown in FIG. 4. In this embodiment, the locking dogs 30 are located generally centrally between the first end 11*a* and second end 11*b* of the connector body 11.

The connector 10 is further provided with a locking element, which in this example is a locking ring 13, which is engages with the locking dogs 30 to slide them along an axis of locking dog movement between an operative position in which they can engage with the member 32, and an inoperative position in which they release the member. In this embodiment, the axis of locking dog movement is perpendicular to the longitudinal axis A of the passage 31 in the connector body 11.

The locking element is moved by an actuator, which in this embodiment comprises an actuation sleeve 12 arranged about the connector body 11 at the second end 11*b* thereof. The locking ring 13 is arranged about the connector body 11 between the first end 11*a* and second end 11*b* thereof so that it engages with the actuation sleeve 12 and the locking dogs 30. The connector 10 further comprises an unlock piston 14 disposed in an annular chamber between the connector body 11 and the actuation sleeve 12.

Figure 5:
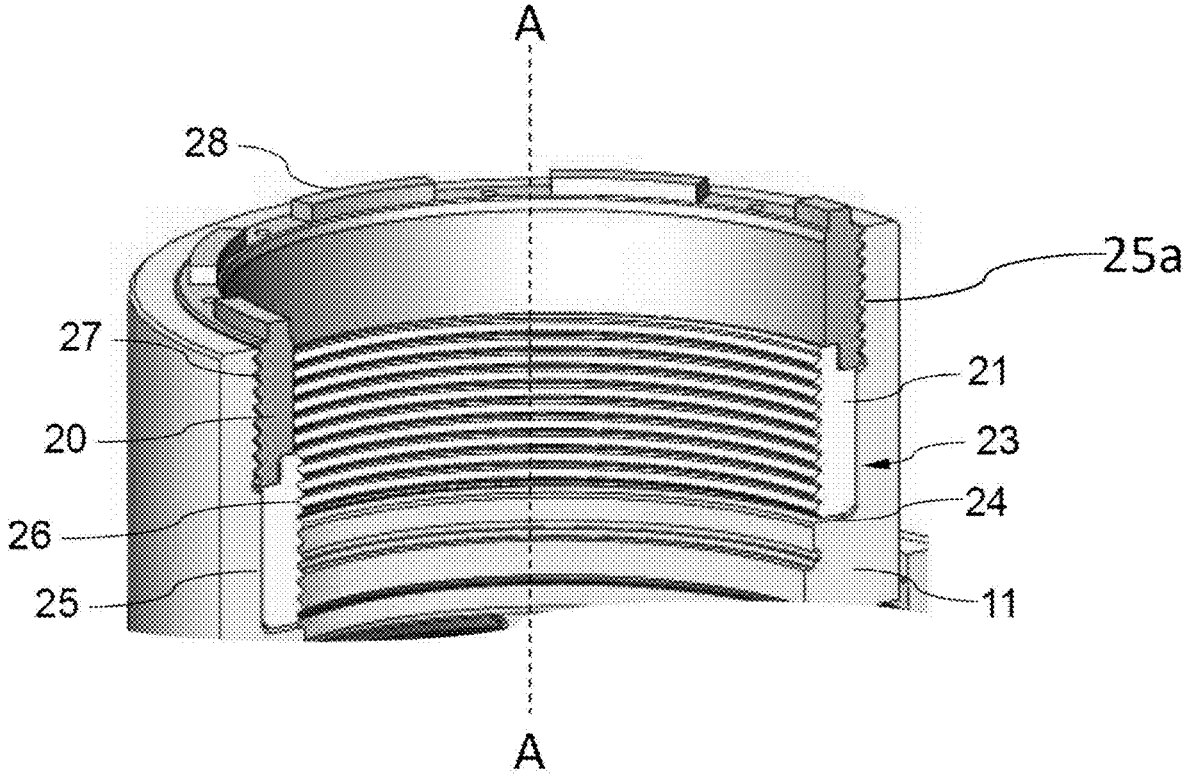
FIG. 5 is a perspective, cut-away, view of the first end of the connector illustrated in FIG. 3.

The upper threaded ring 20 and lower threaded ring 21 are illustrated in more detail in FIG. 5.

The first end 11*a* of the connector body 11 comprises a first receiver section 23 which is configured for receiving the threaded rings 20, 21. The first receiver section 23 is formed within the inner passage 31 of the connector body 11 and has a shoulder 24 for supporting the lower threaded ring 21 so that the lower threaded ring 21 cannot move parallel to the longitudinal axis A of the passage 31 from the first receiver section 23 towards the second end 11*b* of the connector body 11. To achieve this, the passage 31 has a larger diameter portion at the first end 11*a* of the connector body 11, and a smaller diameter portion adjacent the larger diameter portion, the shoulder 24 lying between the larger diameter portion and the smaller diameter portion. The shoulder 24 may comprise a face which is substantially perpendicular to the longitudinal axis A of the passage 31 (i.e., extends radially inwardly relative to the connector body 11), or be oriented at an angle of less than 90° to the longitudinal axis A so that a required longitudinal support is provided for the lower threaded ring 21.

Movement of the upper threaded ring 20 parallel to the longitudinal axis A of the passage 31 towards the second end 11*b* of the connector body 11 is restricted by the engagement of the upper threaded ring 20 with the lower threaded ring 21.

Radial, sideways support of the threaded rings 20, 21 is provided by the radially inwardly facing surface 25 of the connector body 11, which engages with the radially outwardly facing surface of the threaded rings 20, 21. The threaded rings 20, 21 are thereby supported and substantially prevented from moving longitudinally towards the second end 11*b* of the connector body 11, and sideways within the connector body 11 by the shoulder 24 and radially inwardly facing surface 25.

In this embodiment, the upper threaded ring 20 is provided with a thread 27 on its radially outwardly facing surface, and, in use, this thread 27 engages with the corresponding thread 25*a* on the radially inward facing surface 25 of the connector body 11 at the first end 11*a* thereof. The lower threaded ring 21 is provided with a thread 26 on its radially inwardly facing surface, and, in use, this thread 26 engages with a corresponding thread 22*a* on the radially outwardly facing surface of the body 22. The threads 26, 27 are advantageously oppositely directed so that the lower threaded ring 21 is screwed onto the corresponding thread 25*a* on the body 22 by rotating the lower threaded ring 21 in a first direction, while the upper threaded ring 20 is screwed onto the corresponding thread on the connector body 11 by rotating the upper threaded ring 20 in a second, opposite direction.

When installed, as illustrated in FIGS. 3, 4 and 5, the upper threaded ring 20 will lock the lower threaded ring 21 in place and provide longitudinal support to restrict movement of the lower threaded ring 21 parallel to the passage 31 towards the first end 11*a* of the connector body 11. The lower threaded ring 21 is thus held in the first receiver section 23 by virtue of the engagement of the thread 27 of the upper threaded ring 20 with the connector body 11.

The upper threaded ring 20 may have tool engagement members, such as protrusions extending upwardly from an upper face of the upper threaded ring 20, which can be engaged by an installation tool during installation, in order to provide the required torque to install the upper threaded ring 20.

Figure 6:
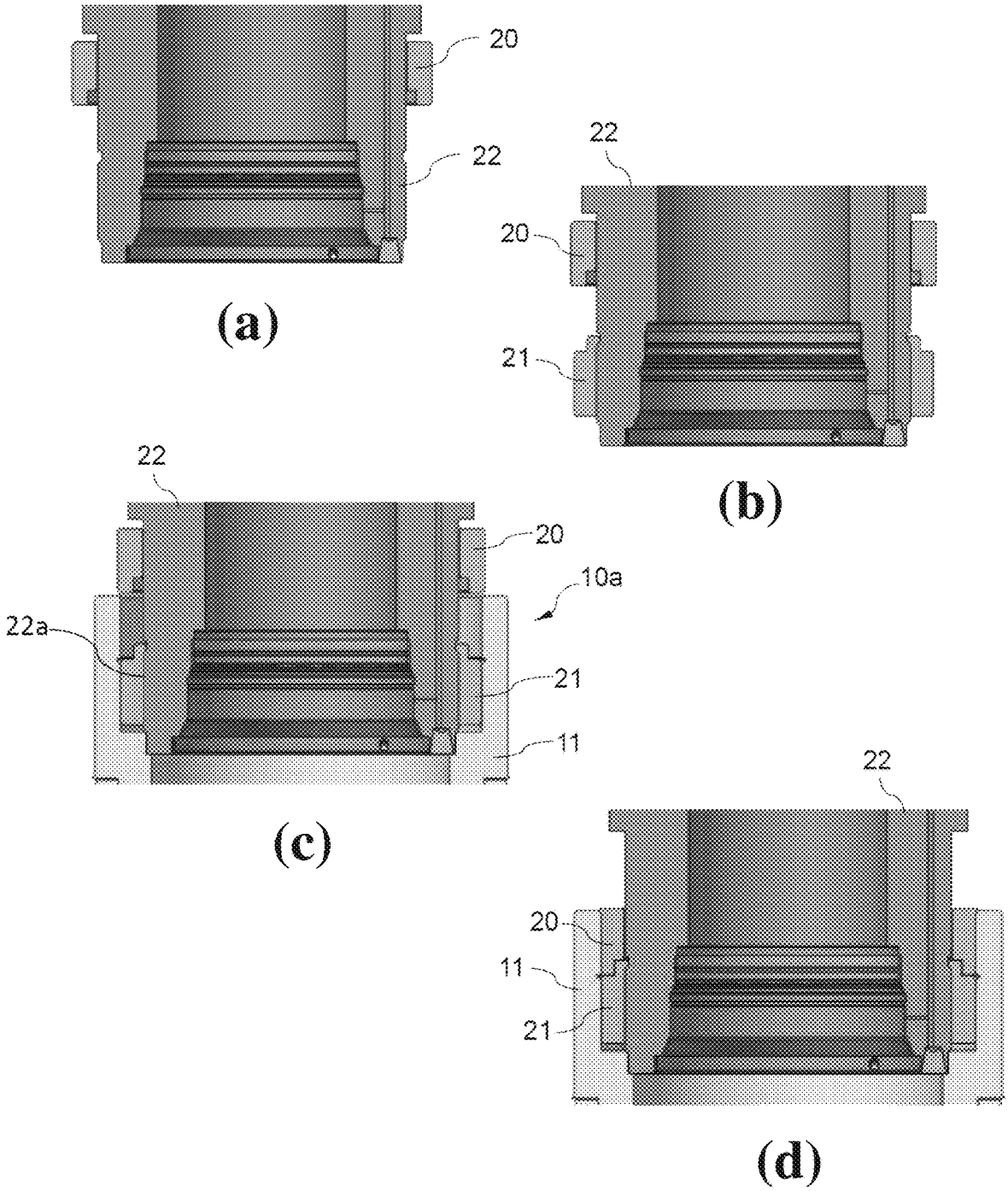
FIG. 6 is an illustration of the longitudinal cross-section through a body to be secured to the connector illustrated in FIG. 3 with, (a) the upper threaded ring of the connector mounted on the body, (b) the upper and lower threaded rings of the connector mounted on the body, (c) the lower end of the body inserted into the first received section of the connector, and (d) with the body locked in place in the connector by the upper and lower threaded rings.

FIG. 6 illustrates an installation sequence of the connector 10 to the lower end of the body 22. The upper threaded ring 20 is first slid on to the lower end of the body 22 (*a*), and then the lower threaded ring 21 is mounted on the lower part of the body 22 by engaging its thread 26 with the corresponding thread 22*a* on the radially outwardly facing surface of the lower part of the body 22 and rotating the lower threaded ring 21 around the body 22 in the first direction (b).

The lower part of the body 22 with the lower threaded ring 21 is fed into the first receiver section 23 of the connector body 11 from the first end 11*a* of the connector body 11 (*c*), and then the upper threaded ring 20 is screwed onto the thread 25*a* on the radially inwardly facing surface 25 of the connector body 11, until it engages with the lower threaded ring 21 and locks the lower threaded ring 21 in place within the connector body 11 (*d*).

Figure 7:
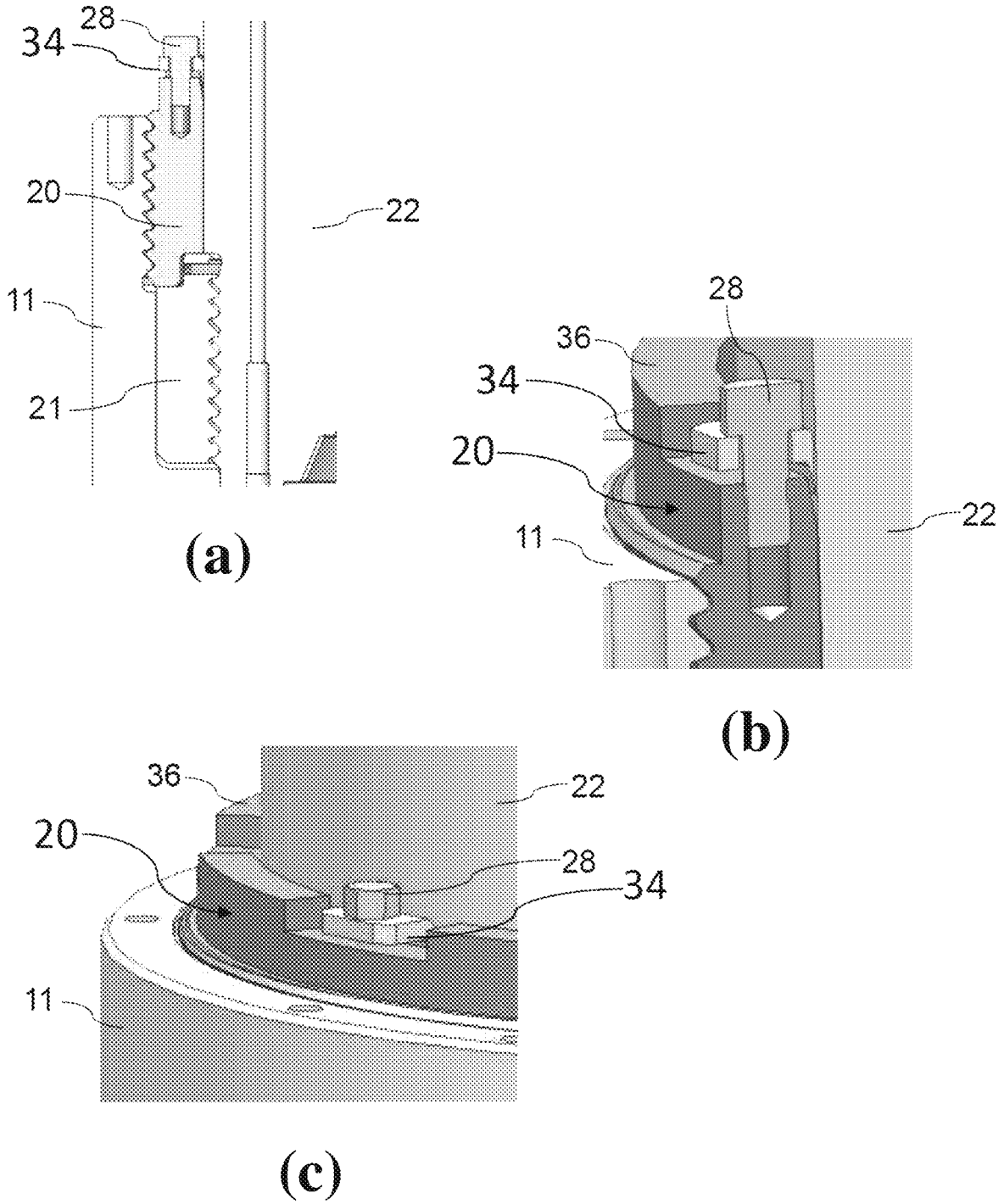
FIG. 7 illustrates the locking devices used to lock the body illustrated in FIG. 6 to the connector, with (a) illustrating a partial longitudinal cross-section through the first end of the connector and lower end of the body, (b) being a cutaway perspective view of a portion of the first end of the connector and lower end of the body illustrated in (a) of FIG. 7, and (c) illustrating a perspective view of first end of the connector and lower end of the body illustrated in (a) of FIG. 7.

Locking devices 28 may be provided to rotationally lock the upper threaded ring 20 to prevent the upper threaded ring 20 from rotating (unscrewing) when installed. The locking devices 28 may, for example, be bolts, as illustrated in FIG. 7. In this embodiment, once the upper threaded ring 20 is in place as shown in (d) of FIG. 6, a plurality of bolt support flanges 34 are secured to the radially outwardly facing surface of the body 22. Each bolt support flange 34 is provided with an aperture, and they are each arranged so that this aperture is aligned with a corresponding threaded aperture provided in the top edge 36 of the upper threaded ring 20 (i.e., the edge which is distal to the lower threaded ring 21). The shank of a bolt 28 may then be inserted into the aperture of each of the bolt support flanges 34 so that the shank passes into the corresponding aperture in the upper threaded ring 20. When in place, the bolts 28 thus prevent any further rotation of the upper threaded ring 20 relative to the body 22.

The shank of the bolt 28 and the aperture provided in each bolt support flange 34 may be threaded, so that the bolt 28 must be screwed into the aperture.

In this embodiment, the top edge 36 of the upper threaded ring 20 is castellated, and each aperture, and bolt support flange 34 is located in a recessed portion of the top edge 36.

While a plurality of bolt support flanges 34 are provided in this example, each with a single aperture, it will be appreciated that the bolt support flanges 34 could be large enough to accommodate a plurality of apertures. In fact, a single bolt support flange 34 could be provided, which extends around the entire, or substantially the entire, circumference of the body 22, with an array of generally evenly spaced apertures being provided.

Figure 8:
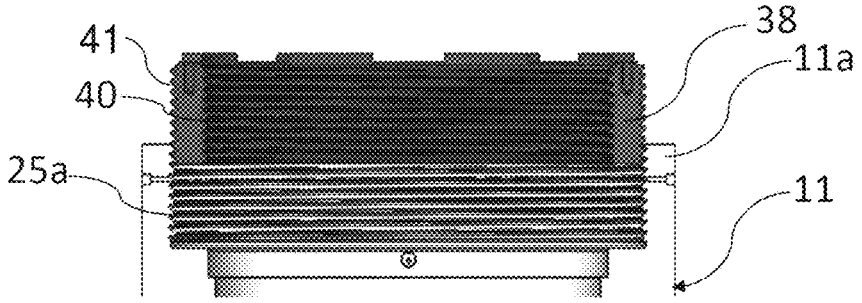
FIG. 8 is an illustration of an alternative embodiment of the connector, with (a) showing a longitudinal cross-section through the first end of the alternative embodiment of connector, (b) showing a longitudinal cross-section through the first end of the alternative embodiment of connector with threaded ring in place around a body, and (c) showing a longitudinal cross-section through the first end of the alternative embodiment of connector with the member locked in place.
Figure 8:
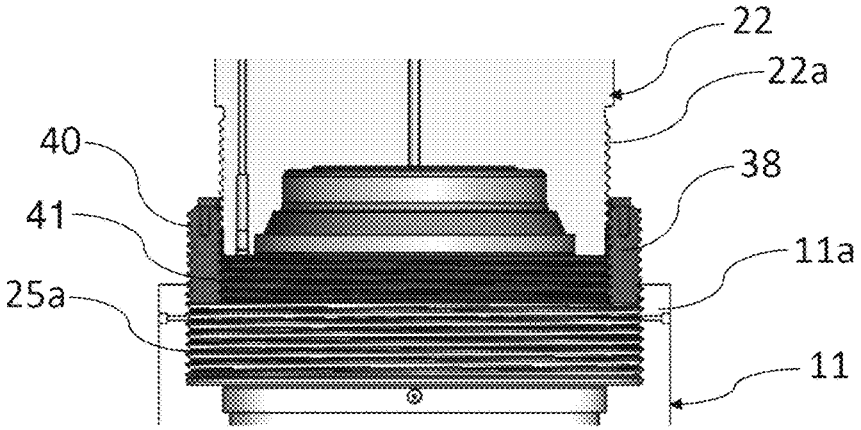
Figure 8:
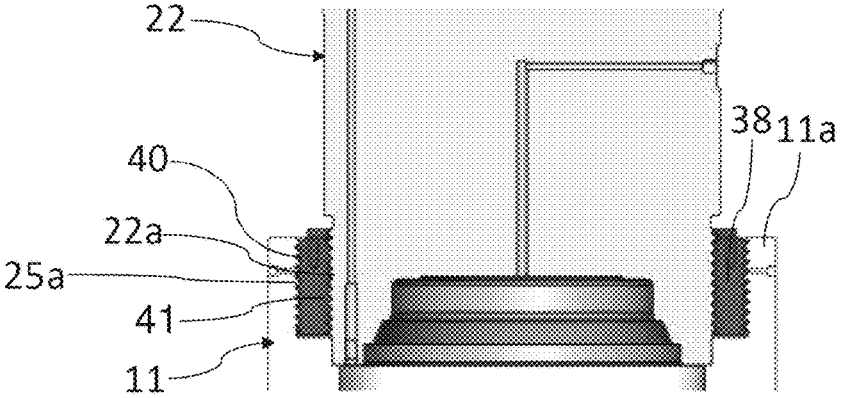

An alternative embodiment is illustrated in FIG. 8 in which, instead of being provided with separate upper threaded ring 20 and the lower threaded ring 21, the connector 10 is provided with a single threaded ring 38, which has oppositely directed threads 40, 41 on its radially outwardly facing and radially inwardly facing surfaces which engage with corresponding threads 25*a*, 22*a* on the radially inwardly facing surface 25 of the connector body 11 and the radially outwardly facing surface of the body 22 respectively.

In this case, the body 22 may be secured to the connector body 11 by screwing the threaded ring 38 onto the thread 25*a* at the first end 11*a* of the connector body 11 by a few turns, until the threaded ring 38 is firmly secured to the first end 11*a* of the connector body 11, but not fully inserted into the first receiver section 23, as illustrated in (a) of FIG. 8. The body 22 is then screwed into the threaded ring 38, as illustrated in (b) of FIG. 8, as far as possible, at which point the threaded ring 38 is rotated further to screw it into the first receiver section 23 as far as possible, as illustrated in (c) of FIG. 8. A locking device, such as the bolts 28 described above, may then be used to lock the threaded ring 38 and substantially prevent any further rotation of the threaded ring 38 relative to the body 22.

Figure 9:
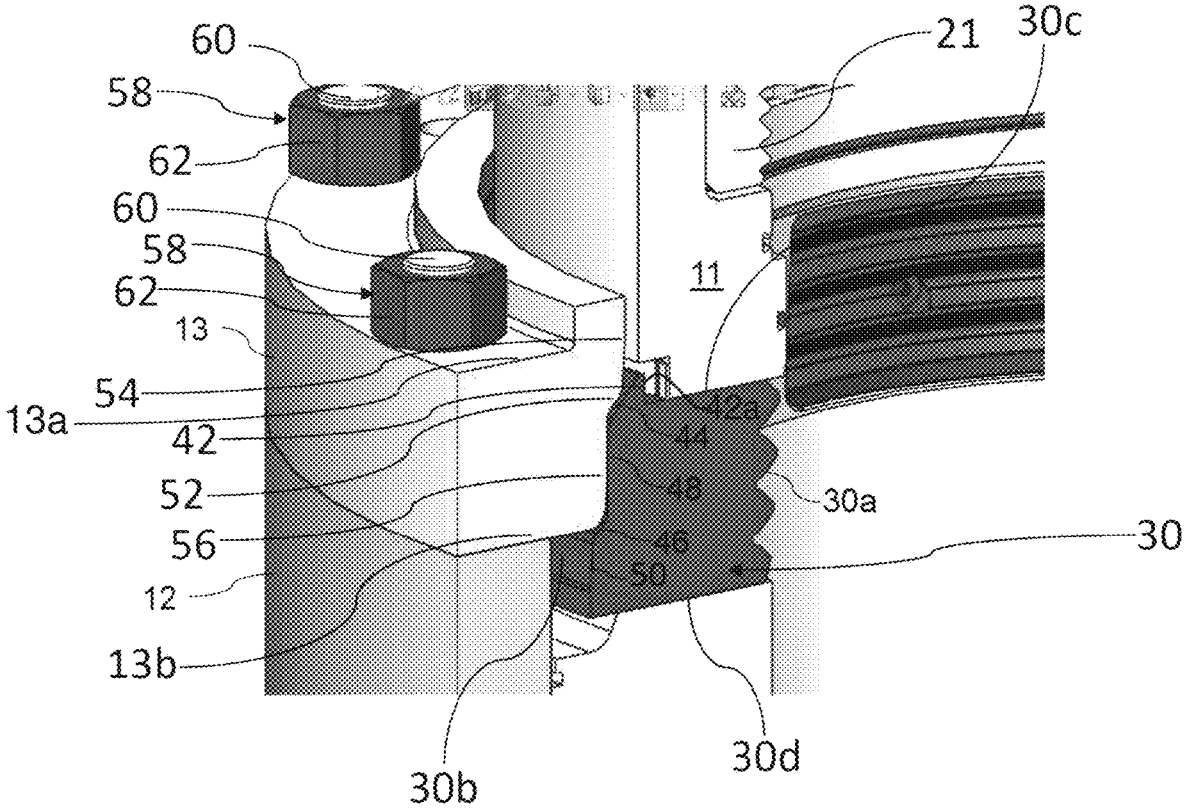
FIG. 9 is a cut-away perspective view of the locking dogs and locking ring of a connector according to the present invention.
Figure 10:
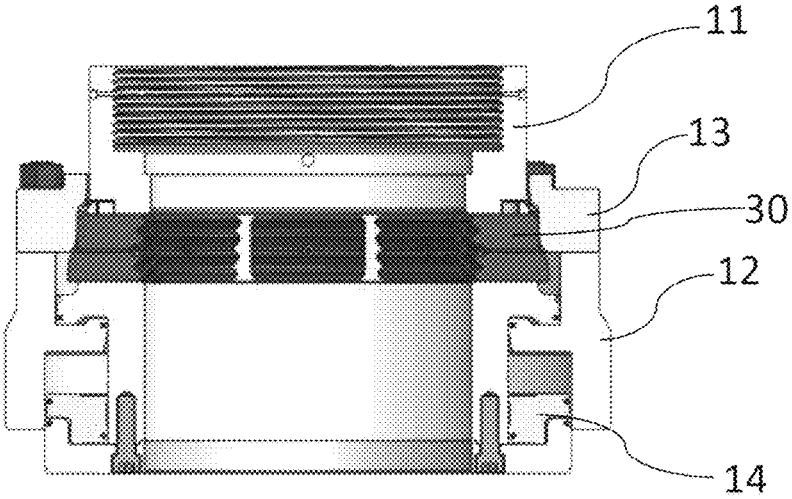
FIG. 10 shows a longitudinal cross-section through a the connector illustrated in FIG. 9, where in (a) the locking dogs have been moved to their inoperative position and the locking ring to its unlock position by the primary unlock means, (b) with the locking dogs in their operative position, and the locking ring in its lock position, and (c) the locking dogs having been moved to their inoperative position and the locking ring to its unlock position by the primary unlock means.
Figure 10:
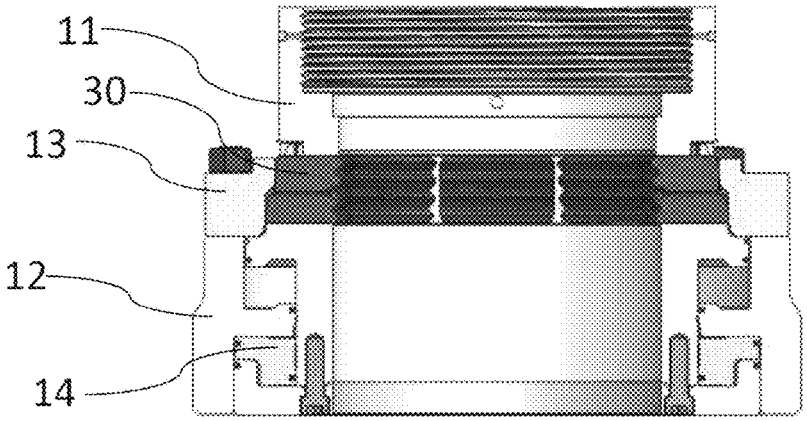
Figure 10:
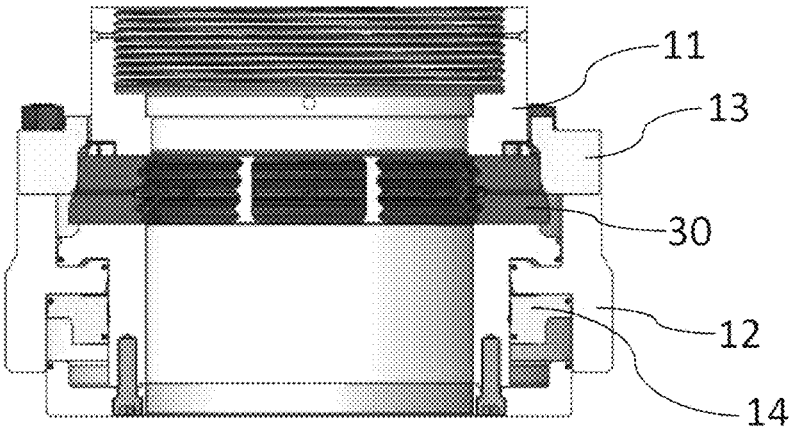

Turning now to the device for securing the member 32 to the connector 10, the locking dogs 30 and locking ring 13 are illustrated in more detail in FIGS. 9 and 10. As mentioned above, each locking dog 30 has a front face 30*a* which is provided with a plurality of teeth or serrations which, in use, are pushed into engagement with the member 32 to lock it in place in the connector body 11. As such, the teeth or serrations comprise a plurality of grooves which lie generally perpendicular to the longitudinal axis A of the passage 31.

Each locking dog 30 also has a rear face 30*b*, which is opposite to the front face 30*a*, and an upper face 30*c* and a lower face 30*d* which are generally parallel to one another. The upper face 30*c* and lower face 30*d* engage with the connector body 11, and are flat, so that the locking dog 30 can slide in the opening in the connector body 11 in a radial direction perpendicular to the longitudinal axis A of the passage 31 between an operative position in which the front face 30*a*, and portions of the upper and lower faces 30*c*, 30*d* adjacent the front face 30*a* lie in the passage 31 of the connector body 11, and an inoperative position in which the locking dog 30 is retracted radially outwardly relative to the operative position. In this example, when the locking dog 30 is in the inoperative position, the front face 30*a* does not extend into the passage 31 of the connector body 11.

A stop 42 extends from the upper face 30*c* adjacent its edge with the rear face 30*b*, the stop 42 having a front face 42*a* which extends perpendicular to the upper face 30*c*, and which is arranged to engage with the radially outwardly facing surface of the connector body 11 when the locking dog 30 is in the operative position. The stop 42 thus limits movement of the locking dog 30 in the radially inward direction.

The locking ring 13 can move axially along the outside of the connector body 11 between an unlock position to a lock position, and in this embodiment, the movement from the unlock position to the lock position involves movement of the locking ring 13 towards the second end 11*b* of the connector body 11. The rear face 30*b* of each locking dog 30 is shaped to engage with the locking ring 13 in such a way that movement of the locking ring 13 from the unlock position to the lock position pushes the locking dogs 30 along the axis of locking dog movement from the inoperative position to the operative position.

The rear face 30*b* of each locking dog has a first inclined portion 44 which extends from the stop 42 at an angle of between 1° and 80°, in this example approximately 45°, to the front face 42*a* of the stop 42, and the upper face 30*c* of the locking dog 30, so that the first inclined portion 44 of the rear face 30*b* is inclined towards the first end 11*a* of the connector body 11. The rear face 30*b* of the locking dog has a second inclined portion 46, which is also inclined towards the first end 11*a* of the connector body 11, at an angle of between 1° and 80°, in this example around 45° to the upper and lower faces 30*c*, 30*d* of the locking dog 30. An intermediate portion 48 which is generally perpendicular to the upper and lower faces 30*c*, 30*d*, is located between the two inclined portions 44, 46, and an end portion 50, which is also generally perpendicular to the upper and lower faces 30*c*, 3*d*, extends from the second inclined portion 46 to the lower face 30*d* of the locking dog 30.

The radially inwardly facing surface of the locking ring 13 is provided with a corresponding inclined portion 52, which is inclined so that it can lie flush against either the first inclined portion 44 or the second inclined portion 46 of the rear face 30*b* of each locking dog 30. In this example, the inclined portion 52 of the locking ring 13 is inclined at an angle of around 45° to the longitudinal axis A of the passage 31. The inclined portion 52 lies between first and second end portions 54, 56 which are generally parallel to the longitudinal axis A and extend from a first end face 13*a* of the locking ring 13 adjacent to the first end 11*a* of the connector body 11 to the inclined portion 52, and from a second end face 13*b* of the locking ring 13 adjacent the second end 11*b* of the connector body 11, respectively. The edge of the locking ring 13 at the intersection between the second end portion 56 and second end face 13*b* of the locking ring 13 is rounded.

The locking ring 13 is configured so that when it is in the unlock position, the intermediate portion 48 of the rear face 30*b* of each locking dog 30 bears against the second end portion 56 of the locking ring 13, as illustrated in FIG. 9 and in (a) and (c) of FIG. 10. When the locking ring 13 moves from the unlock position towards the second end 11*b* of the connector body 11, the inclined portion 52 of the locking ring 13 bears on the first inclined portion 44 of the locking dogs 30, and the rounded edge at the second end face 13*b* of the locking ring 13 bears on the second inclined portion 46, pushing the locking dogs 30 inwardly towards the passage 31 of the connector body 11. As movement of the locking ring 13 towards the second end 11*b* of the connector body 11 continues, it reaches the lock position when the first end portion 54 of the locking ring 13 comes into engagement with the intermediate portion 48 of the locking dogs 30, and the second end portion 56 of the locking ring 13 comes into engagement with the end portion 50 of the locking dogs 30 as illustrated in (b) of FIG. 10. The locking dogs 30 have at this point reached their operative position.

Figure 11:
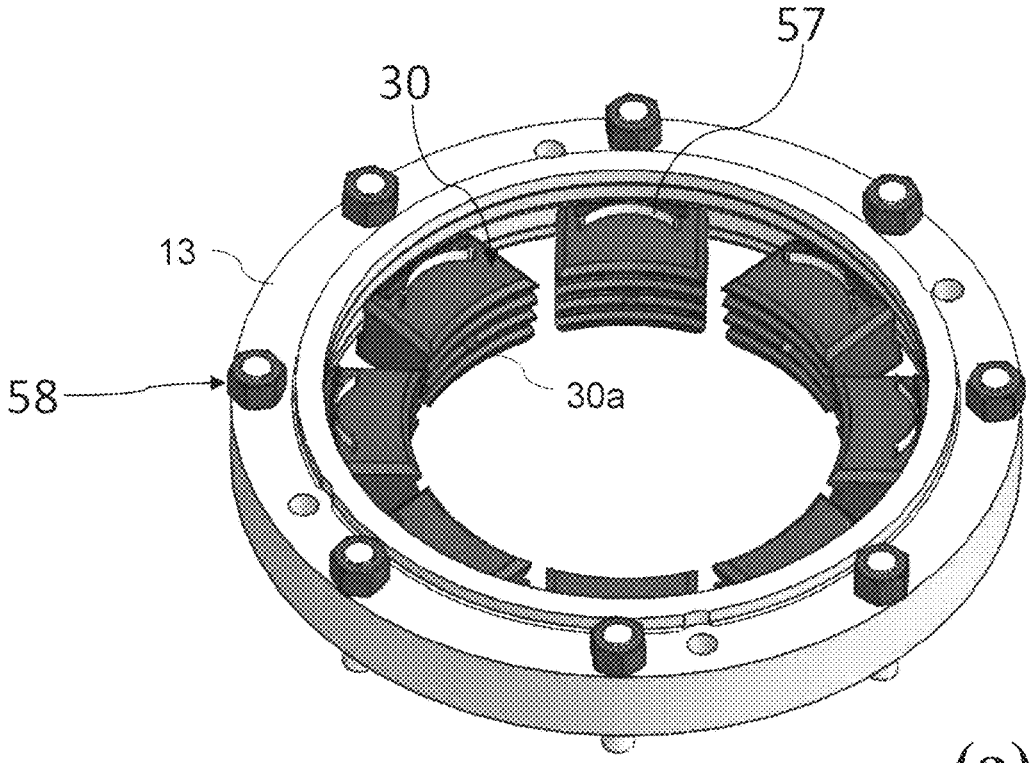
FIG. 11 shows a perspective view of the locking ring and locking dogs of the connector illustrated in FIGS. 9 and 10, where (a) shows the locking dogs in their inoperative position, and where (b) shows the locking dogs in their operative position.
Figure 11:
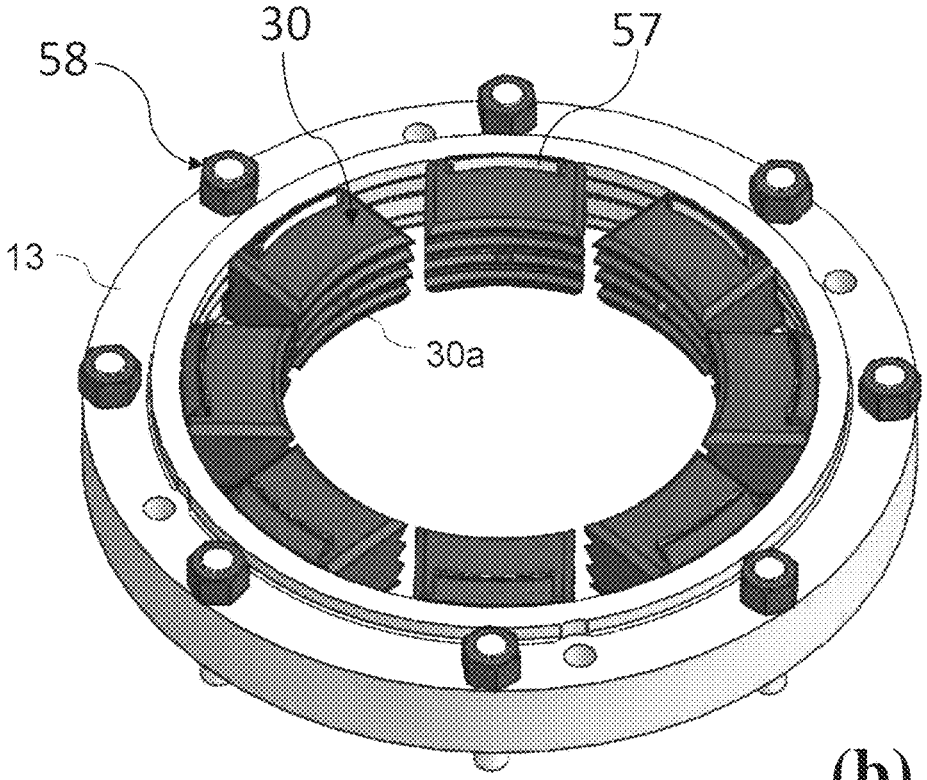

In this embodiment, the locking dogs 30 are each biased towards the inoperative position using a resilient biasing element, which in this example comprises a leaf spring 57, which is best illustrated in (a) and (b) of FIG. 11. The leaf spring 57 comprises an elongate strip of a resilient material such as spring steel. The ends of the leaf spring 57 lie against the radially outwardly facing surface of the connector body 11, and the leaf spring 57 is curved so that a central portion extends towards the stop 42 of its respective locking dog 30, as illustrated in (a) of FIG. 11. As the locking dog 30 moves from the inoperative position to the operative position, the front face 42*a* of the stop 42 engages with the central portion of the leaf spring 57. As this movement of the locking dog 30 continues, the leaf spring 57 is flattened, as illustrated in (b) of FIG. 11. When the force from the locking ring 13 moving the locking dog 30 to the operative position is removed, the leaf spring 57 pushes the locking dog 30 back to the in operative position in order to restore its curved shape.

Movement of the locking ring 13 between the unlock position and the lock position is achieved using the actuation sleeve 12. The actuation sleeve 12 is moved by the supply of pressurized fluid to an unlock chamber (to move the locking ring 13 to the unlock position) or a lock chamber (to move the locking ring 13 to the lock position).

The actuation sleeve 12 is secured to the second end face 13*b* of the locking ring 13, in this embodiment using a plurality of nut and bolt assemblies 58, each of which comprises a threaded shank 60 which extends through an aperture in the locking ring 13 from the first end face 13*a* to the second end face 13*b* and into a corresponding threaded aperture in the actuation sleeve 12. A nut 62 is mounted on an end of each threaded shank 60 to bear on the first end face 13*a* of the locking ring 13. The nut and bolt assemblies 58 are regularly spaced in an array around the entire locking ring 13.

Figure 12:
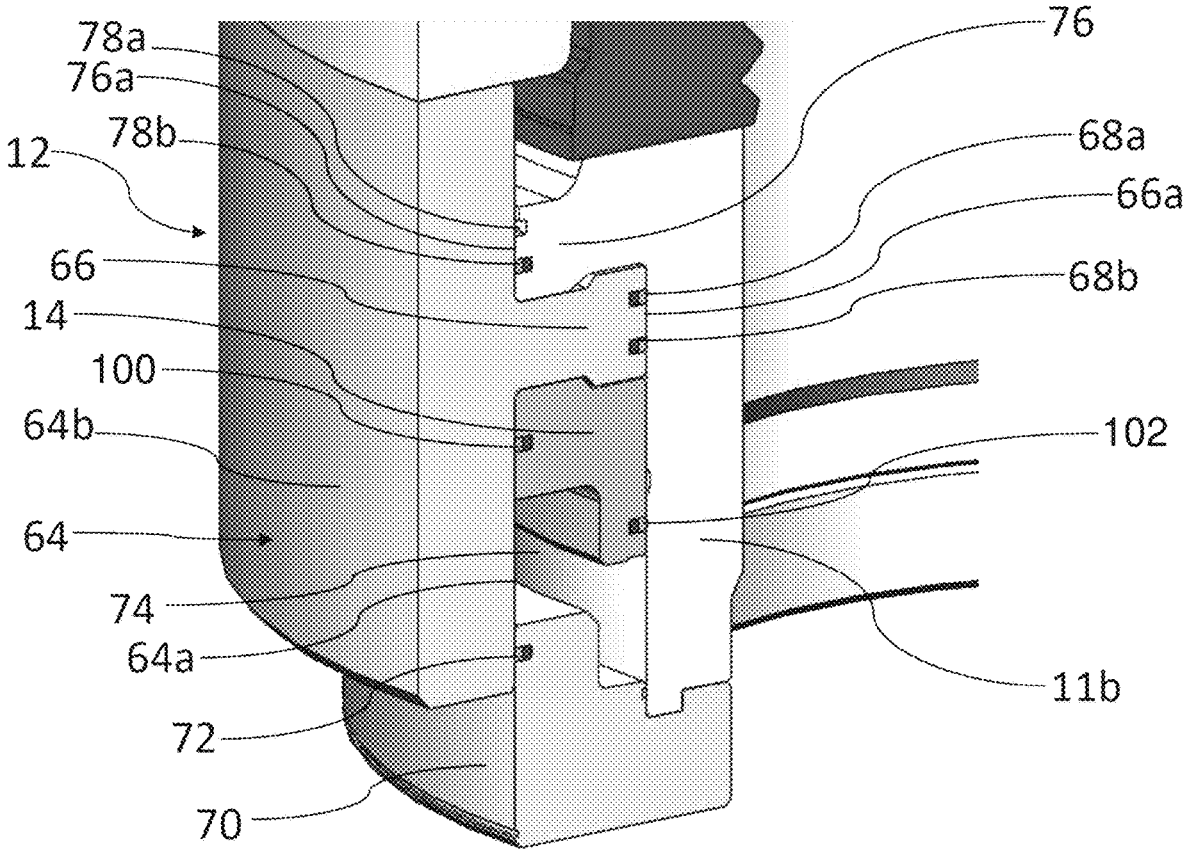
FIG. 12 shows a cut-away perspective view of the actuation sleeve and second end of the connector illustrated in FIGS. 9, 10 and 11 with the actuation sleeve position to locate the locking ring in its unlock position.
Figure 13:
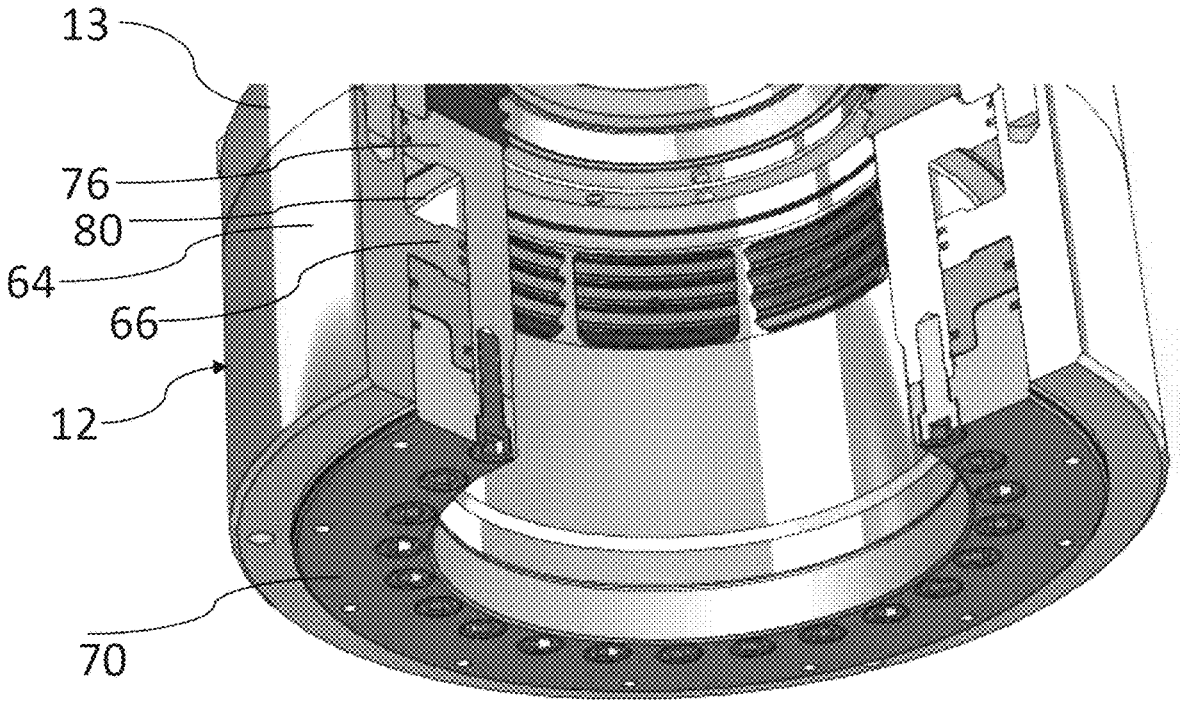
FIG. 13 shows a cut-away perspective view of the actuation sleeve and second end of the connector illustrated in FIGS. 9, 10 and 11 with the actuation sleeve position to locate the locking ring in its lock position.

The actuation sleeve 12 is best illustrated in FIGS. 12 and 13 and comprises a main body 64 which has a radially inwardly facing surface 64*a* and a radially outwardly facing surface 64*b* and encloses a cylindrical space which has a larger diameter than the outer diameter of the connector body 11. The main body 64 of the actuation sleeve 12 is thereby spaced from the connector body 11.

A separator flange 66 extends from the radially inwardly facing surface 64*a* generally perpendicular to the longitudinal axis A of the passage 31 of the connector body 11. The separator flange 66 has an end face 66*a* which engages with the radially outwardly facing surface of the connector body 11 to form a substantially fluid tight seal between the connector body 11 and the separator flange 66 while allowing the actuation sleeve 12 to move relative to the connector body 11 generally parallel to the longitudinal axis A. In this embodiment, the seal is provided by two ring seals 68*a*, 68*b*, which are each mounted in a groove around the circumference of the end face 66*a*.

An end plate 70 is secured to the second end 11*b* of the connector body 11 to close the space between the connector body 11 and the main body of the actuation sleeve 12 at the second end 11*b* of the connector body 11. The end plate 70 can, for example, have an annular shape. A seal 72 is provided between the end plate 70 and the radially inwardly facing surface 64*a* of the main body 64 of the actuation sleeve 12, which allows sliding movement of the actuation sleeve 12 relative to the connector body 11 parallel to the longitudinal axis A while providing a substantially fluid tight seal between the actuation sleeve 12 and the connector body 11. The end plate 70, second end 11*b* of the connector body 11, separator flange 66, and main body 64 of the actuation sleeve 12, thus form a sealed annular unlock chamber 74 around the connector body 11 (best seen in FIG. 12).

A sealing flange 76 extends from the radially outwardly facing surface of the connector body 11 between the locking dogs 30 and the separator flange 66. The sealing flange 76 can, for example, have an annular shape. The separator flange 66 can, for example, have an annular shape. The sealing flange 76 extends generally perpendicular to the longitudinal axis A, and has an end face 76*a* which engages with the radially inwardly facing surface 64*a* of the main body of the actuation sleeve 12 to form a substantially fluid tight seal between the main body 64 of the actuation sleeve 12 and the sealing flange 76 while allowing the actuation sleeve 12 to move relative to the connector body 11 generally parallel to the longitudinal axis A. In this embodiment, the seal is provided by two ring seals 78*a*, 78*b*, which are each mounted in a groove around the circumference of the end face 76*a*. An annular lock chamber 80 is therefore formed around the connector body 11 between the sealing flange 76, the connector body 11, and the main body 64, and separator flange 66 of the actuator sleeve 12 (best seen in FIG. 13).

Conduits are provided through the connector body 11 via which pressurized fluid may be supplied to the unlock chamber 74 and the lock chamber 80. These are best illustrated in (a) and (b) of FIG. 14.

As illustrated in (a) of FIG. 14, an unlock conduit 82 extends from an unlock inlet port 84 provided in the radially outwardly facing surface of the connector body 11 longitudinally between the locking dog 30 receiving windows and the first end 11*a* of the connector body 11. As such, when the connector 10 is assembled with the locking ring 13 mounted around the connector body 11, the unlock inlet port 84 is above the locking ring 13, as illustrated in FIG. 3, and is therefore accessible. The unlock conduit 82 extends from the unlock inlet port 84 to an unlock outlet port 86 on the radially outwardly facing surface of the connector body 11 between the end plate 70 and the separator flange 66, so as to connect the unlock inlet port 84 to the unlock chamber 74. In this embodiment, most of the unlock conduit 82 extends generally parallel to the longitudinal axis A, and has a first end portion 82*a* which extends generally perpendicular to the longitudinal axis A to the unlock inlet port 84, and a second end portion 82*b* which extends to the unlock outlet port 86. Also in this example, the unlock outlet port 86 forms an annular groove around the radially inwardly facing surface of the connector body 11 into the unlock chamber 74.

As illustrated in (b) of FIG. 14, a lock conduit 88 extends from a lock inlet port 90 provided at the first end 11*a* of the connector body 11 to a lock outlet port 92 provided on a lower side of the sealing flange 76 into the lock chamber 80. The lock conduit 88 in this embodiment extends generally parallel to the longitudinal axis A.

The locking ring 13 can therefore be moved from the unlock position illustrated in FIG. 9, by the supply of pressurized fluid to the lock inlet port 90. The pressurized fluid enters the lock chamber 80 and pushes the separator flange 66 away from the sealing flange 76 to expand the lock chamber 80, and the separator flange 66 towards the end plate 70 to contract the unlock chamber 74, as illustrated in FIG. 13, thereby moving the actuation sleeve 12 towards the second end 11*b* of the connector body 11, the actuation sleeve 12 pulling the locking ring 13 down from the unlock position to the lock position. The locking ring 13 in turn pushes the locking dogs 30 to the operative position to secure the member 32 in the connector body 11.

To release the member 32, the pressurized fluid in the lock chamber 80 is exhausted or released, and pressurized fluid is supplied to the unlock inlet port 84. The pressurized fluid enters the unlock chamber 74 and pushes the separator flange 66 away from the end plate 70 to expand the unlock chamber 74, and towards the sealing flange 76 to contract the lock chamber 80, as illustrated in FIG. 12. This moves the actuation sleeve 12 towards the first end 11*a* of the connector body 11, the actuation sleeve 12 pushing the locking ring 13 up from the lock position to the unlock position, thus allowing the locking dogs 30 to return to their inoperative position under the action of the leaf spring 57.

It should be appreciated that the faces of the locking ring 13 and locking dogs 30 which are in engagement when the locking ring 13 is in the lock position, namely the intermediate portion 48 of the locking dogs 30 and first end portion 54 of the locking ring 13 and the end portion 50 of the locking dogs 30 and the second end portion 56 of the locking ring 13, all lie generally perpendicular to the direction of movement of the locking dogs 30. As such, when the locking dogs 30 are in their operative position locking a member 32 in the connector 10, any force transferred to the locking dogs 30 pushing the locking dogs 30 back towards their inoperative position, as a result of external forces acting on the member 32, will not be transferred to the locking ring 13 in such a way as to force the locking ring 13 back to its unlock position. Thus, once the locking ring 13 has been moved to the lock position, it is not necessary to maintain pressure in the lock chamber 80 in order to keep the locking ring 13 in the lock position. The pressure in the lock chamber 80 can be released, without significant likelihood of accidental release of the member 32 from the connector 10 through unintended movement of the locking ring 13 to the unlock position.

A connector 10 such as this can be left in a subsea environment for significant periods of time with the locking dogs 30 operative and the locking ring 13 in its lock position. This can give rise to a failure of the ring seals 68*a*, 68*b* between the separator flange 66 and the connector body 11*b*. If this occurs, when pressurized fluid is supplied to the unlock inlet port 84, fluid could flow across the separator flange 66, from the unlock chamber 74 into the lock chamber 80 and so the desired expansion of the unlock chamber 74 will not occur, and so the locking ring 13 will remain in its lock position, and it will not be possible to remove the member 32 from the connector body 11.

To reduce the risk of this occurring, in this embodiment of the present invention, a secondary unlock mechanism is provided. This comprises an unlock piston 14 which is disposed in the annular chamber between the connector body 11 and the actuation sleeve 12, and between the separator flange 66 and the end plate 70. A seal 100, in this example a ring seal, is provided between the unlock piston 14 and the radially inwardly facing surface of the actuation sleeve 12, and a further seal 102, in this example a ring seal, is provided between the unlock piston 14 and the radially outwardly facing surface of the connector body 11. These seals 100, 102 allow the unlock piston to slide along the outside of the connector body 11, while providing a substantially fluid tight seal. As such, the unlock piston 14, divides the unlock chamber 74 into two annular volumes-a lower annular volume between the end plate 70 and the unlock piston 14, and an upper annular volume between the separator flange 66 and the unlock piston 14.

The unlock outlet port 86 is located in the upper annular volume between the separator flange 66 and the unlock piston 14, and a secondary unlock outlet port 94 is provided in the radially inwardly facing surface of the connector body 11 at the second end 11*b* thereof, and adjacent the end plate 70, to provide means of supplying fluid to the lower annular volume of the unlock chamber 74. The secondary unlock outlet port 94 is connected to a secondary unlock inlet port 96 via a secondary inlet conduit 98 (illustrated in (c) of FIG. 14). The secondary unlock inlet port 94, like the unlock inlet port 84, is provided in the radially outwardly facing surface of the connector body 11 longitudinally between the locking dog 30 receiving windows and the first end 11*a* of the connector body 11. As such, when the connector 10 is assembled with the locking ring 13 mounted around the connector body 11, the secondary unlock inlet port 94 is above the locking ring 13, and is therefore accessible.

When pressurized fluid is supplied to the lock chamber 80, and the unlock chamber 74 exhausted by venting both the unlock inlet port 84 and secondary inlock inlet port 94, the unlock piston 14 is pushed down by the separator flange 66 into engagement with the end plate 70, until it is clamped between the annular separator flange 66 and the end plate 70.

The locking ring 13 can be moved to the unlock position in two ways: by the supply of pressurized fluid to the unlock inlet port 84, or by the supply of pressurized fluid to the secondary unlock inlet port 84. If the lock chamber 80 is exhausted, and pressurized fluid is supplied to the unlock inlet port 84, the actuation sleeve 12 is moved as described above, and as illustrated in (a) of FIG. 10. If, however, the seals between the connector body 11 and the separator flange 66 are no longer effective in sealing the unlock chamber 74 from the lock chamber 80, so that this is ineffective, pressurized fluid can, instead, be supplied to the secondary unlock inlet port 94.

As the secondary unlock outlet port 86 is at the second end 11*b* of the connector body 11, fluid from the unlock outlet port 86 enters the lower annular volume of the unlock chamber 74. When the lock chamber 80 is exhausted and pressurized fluid is supplied to the unlock chamber via the secondary unlock outlet port 94, this pressurized fluid expands the lower annular volume of the unlock chamber 74, pushing the unlock piston 14 against the separator flange 66. The unlock piston 14 therefore pushes the actuation sleeve 12 towards the first end 11*a* of the connector body 11, the actuation sleeve 12 pushing the locking ring 13 up from the lock position to the unlock position, thus allowing the locking dogs 30 to return to their inoperative position under the action of the leaf spring 57, as illustrated in (c) of FIG. 10. There is therefore provided a secondary means of releasing the member 32 from the connector 10.

The present invention is not limited by the embodiments described above; reference should be had to the appended claims.

LIST OF REFERENCE NUMERALS

1 Tubing head spool stack
2 Valve tree stack
10 Connector
11 Connector body
11*a* First end (of connector body)
11*b* Second end (of connector body)
12 Actuation sleeve
13 Locking ring
13*a* First end face (of locking ring)
13*b* Second end face (of locking ring)
14 Unlock piston
20 Upper threaded ring
21 Lower threaded ring
22 Body
22*a* Thread
23 First receiver section
24 Shoulder
25 Radially inwardly facing structure
25*a* Thread
26 Thread
27 Thread
28 Locking device/Shank/Bolt
30 Locking dog
30*a* Front face (of locking dog)
30*b* Rear face (of locking dog)
30*c* Upper face (of locking dog)
30*d* Lower face (of locking dog)
31 Passage
32 Member
34 Bolt support flange
36 Top edge (of upper threaded ring)
38 Threaded ring
40 Thread
41 Thread
42 Stop
42*a* Front face
44 First inclined portion
46 Second inclined portion
48 Intermediate portion (of locking dog)
50 End portion (of locking dog)
52 Inclined portion (of locking ring)
54 First end portion (of locking ring)
56 Second end portion (of locking ring)
57 Leaf spring
58 Nut and bolt assembly
60 Threaded shank
62 Nut
64 Main body
64*a* Radially inwardly facing surface
64*b* Radially outwardly facing surface
66 Separator flange
66*a* End face (of annular separator flange)
68*a* Ring seal
68*b* Ring seal
70 End plate
72 Seal
74 Unlock chamber
76 Sealing flange
76*a* End face (of annular separator flange)
78*a* Ring seal
78*b* Ring seal
80 Lock chamber
82 Unlock conduit
82*a* First end portion (of unlock conduit)
82*b* Second end portion (of unlock conduit)
84 Unlock inlet port
86 Unlock outlet port
88 Lock conduit
90 Lock inlet port
92 Lock outlet port
94 Secondary unlock outlet port
96 Secondary unlock inlet port
98 Secondary inlet conduit

100 Seal

102 Further seal

A Longitudinal axis

What is claimed is:

1. A connector for securing to an end of an elongate element, the connector comprising:

a connector body, the connector body comprising a first end, a second end, at least one window, and a radially inward facing surface, the connector body enclosing a main passage having a longitudinal axis, wherein, the main passage extends from the first end to the second end of the connector body and is surrounded by the radially inward facing surface, and the radially inward facing surface at the first end of the connector body has a threaded portion which carries a screw thread;

a first threaded ring comprising a radially outwardly facing surface which carries a screw thread which can be screwed into the threaded portion of the first end of the connector body;

a locking dog which comprises a front end, the locking dog being configured to extend through the at least one window and to be movable between an operative position in which the front end of the locking dog extends into the main passage, and an inoperative position in which the locking dog is retracted radially outwardly relative to the operative position; and a locking part which engages with the locking dog and which is movable via a locking actuator which is operated via a fluid pressure so as to move the locking dog between the operative position and the inoperative position.

2. The connector as recited in claim 1, wherein the at least one window is arranged between the threaded portion and the second end of the connector body.

3. The connector as recited in claim 1, wherein the first threaded ring further comprises:

a radially inward facing surface which carries a screw thread which is oppositely directed to the screw thread on the radially outwardly facing surface.

4. The connector as recited in claim 3, further comprising:

a second threaded ring comprising a radially inward facing surface which carries a screw thread which is oppositely directed to the screw thread on the radially outwardly facing surface of the first threaded ring.

5. A method of securing an elongate element to a connector, wherein, the connector comprises:

a connector body, the connector body comprising a first end, a second end, at least one window, and a radially inward facing surface, the connector body enclosing a main passage having a longitudinal axis, wherein, the main passage extends from the first end to the second end of the connector body and is surrounded by the radially inward facing surface, and the radially inward facing surface at the first end of the connector body has a threaded portion which carries a screw thread;

a locking dog which comprises a front end, the locking dog being configured to extend through the at least one window and to be movable between an operative position in which the front end of the locking dog extends into the main passage, and an inoperative position in which the locking dog is retracted radially outwardly relative to the operative position; and a locking part which engages with the locking dog and which is movable via a locking actuator which is operated via a fluid pressure so as to move the locking dog between the operative position and the inoperative position, and the elongate element comprises, at one end thereof, a screw thread which is arranged on a radially outwardly facing surface, the method comprising:

mounting a first threaded ring having a radially outwardly facing surface which carries a thread onto an end of the elongate element;

screwing a second threaded ring with a radially inward facing surface which carries a screw thread which is oppositely directed to the screw thread on the radially outwardly facing surface of the first threaded ring onto the screw thread on the end of the elongate element;

inserting the end of the elongate element into the main passage of the connector body at the first end thereof; and screwing the first threaded ring into the threaded portion of the first end of the connector body.

6. The method as recited in claim 5, further comprising:

inserting a second elongate element into the main passage of the connector body at the second end thereof; and operating the locking actuator to move the locking dog to the operative position so that the locking dog engages with the second elongate element and locks the second elongate element in the connector body.

7. A method of securing an elongate element to a connector, wherein, the connector comprises:

a connector body, the connector body comprising a first end, a second end, at least one window, and a radially inward facing surface, the connector body enclosing a main passage having a longitudinal axis, wherein, the main passage extends from the first end to the second end of the connector body and is surrounded by the radially inward facing surface, and the radially inward facing surface at the first end of the connector body has a threaded portion which carries a screw thread;

a locking dog which comprises a front end, the locking dog being configured to extend through the at least one window and to be movable between an operative position in which the front end of the locking dog extends into the main passage, and an inoperative position in which the locking dog is retracted radially outwardly relative to the operative position; and a locking part which engages with the locking dog and which is movable via a locking actuator which is operated via a fluid pressure so as to move the locking dog between the operative position and the inoperative position, and the elongate element comprises, at one end thereof, a screw thread which is arranged on a radially outwardly facing surface, the method comprising:

providing a threaded ring which comprises a radially outwardly facing surface which carries an outer screw thread, and a radially inward facing surface which carries an inner screw thread which is oppositely directed to the outer screw thread on the radially outwardly facing surface;

screwing the threaded ring onto the screw thread at the end of the elongate element;

inserting an end of the elongate element into the main passage of the connector body at the first end thereof; and screwing the outer screw thread of the threaded ring into the threaded portion of the first end of the connector body.

8. The method as recited in claim 7, further comprising;

inserting a second elongate element into the main passage of the connector body at the second end thereof; and operating the locking actuator to move the locking dog to the operative position so that the locking dog engages with the second elongate element and locks the second elongate element in the connector body.

* * * * *